US009959800B1

(12) United States Patent
Zhang et al.

(10) Patent No.: US 9,959,800 B1
(45) Date of Patent: May 1, 2018

(54) VOLTAGE COMPENSATION CIRCUITS AND VOLTAGE COMPENSATION METHODS THEREOF

(71) Applicant: Shenzhen China Star Optoelectronics Technology Co., Ltd., Shenzhen, Guangdong (CN)

(72) Inventors: Xianming Zhang, Guangdong (CN); Dan Cao, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 0 days. days.

(21) Appl. No.: 15/853,976

(22) Filed: Dec. 26, 2017

Related U.S. Application Data

(63) Continuation-in-part of application No. 14/905,943, filed on Jan. 18, 2016.

(51) Int. Cl.
*G09G 3/20* (2006.01)
*G09G 3/36* (2006.01)

(52) U.S. Cl.
CPC ..... *G09G 3/2007* (2013.01); *G09G 3/3677* (2013.01); *G09G 2310/0291* (2013.01); *G09G 2330/021* (2013.01)

(58) Field of Classification Search
CPC ..... G09G 2310/0291; G09G 2330/021; G09G 3/2007; G09G 3/3677
See application file for complete search history.

(56) References Cited

U.S. PATENT DOCUMENTS

2010/0066767 A1* 3/2010 Leo ..... G09G 3/3648 345/690
2017/0162165 A1* 6/2017 Xiong ..... G09G 3/3696

* cited by examiner

*Primary Examiner* — Dmitriy Bolotin
(74) *Attorney, Agent, or Firm* — Andrew C. Cheng

(57) ABSTRACT

A voltage compensation circuit and A method thereof are provided. The voltage compensation circuit includes a power management chip, a feedback circuit, and a control circuit. A gate driving voltage (VGH) connects an input end of the control circuit, the input end of the control circuit connects to a first end of the fifth resistor (R5), and a second end of the fifth resistor (R5) connects to a forward input end of the voltage comparator, and first ends of the sixth resistor (R6) and the first capacitor (C1). A second end of the sixth resistor (R6) and a second end of the first capacitor (C1) are grounded, a backward input end of the voltage comparator connects to the reference voltage (VREF), an output end of the voltage comparator connects to a gate of the first FET (Q1). With such configuration, the display performance may be enhanced.

3 Claims, 4 Drawing Sheets

VOLTAGE COMPENSATION CIRCUITS AND VOLTAGE COMPENSATION METHODS THEREOF

CROSS REFERENCE TO RELATED APPLICATIONS

This is a continuation of co-pending patent application Ser. No. 14/905,943, filed on Jan. 18, 2016, which is a national stage of PCT Application Number PCT/CN2015/085811, filed on Jul. 31, 2015, claiming foreign priority of Chinese Patent Application Number 201510424734.7, filed on Jul. 17, 2015.

FIELD OF THE INVENTION

The present invention relates to a liquid crystal display technology field, and more particularly to a voltage compensation circuit and the voltage compensation method thereof.

BACKGROUND OF THE INVENTION

Gate on Array (GOA) technology relates to manufacturing a gate scanning driving circuit of the thin film transistor (TFT) on the substrate. The border of the panel and the cost of the product may be decreased by adopting the GOA technology.

When the GOA solution is adopted, the temperature of the TFTs within the gate scanning driving circuit may vary in accordance with the environment temperature, which results in the drifting of the electron mobility rate of the TFTs. Thus, the driving voltage of the gate scanning driving circuit of the TFTs may be too high or too low. For instance, when the LCD is turned on, as the environment temperature is low, the driving voltage of the gate scanning driving circuit of the TFT is usually too low, which results in an non-uniform grayscale of the LCD. As such, the display performance is bad.

SUMMARY OF THE INVENTION

The technical issue that the embodiment of the present disclosure solves is to provide a voltage compensation circuit and the voltage compensation method thereof to resolve the display issue caused by the variation of the substrate temperature.

In a first embodiment, a voltage compensation circuit includes: a power management chip, a feedback circuit, and a control circuit, wherein: the control circuit includes a first field effect transistor (FET) Q1, a voltage comparator, a fifth resistor (R5), a sixth resistor (R6) and a first capacitor (C1), a gate driving voltage (VGH) connects an input end of the control circuit, the input end of the control circuit connects to a first end of the fifth resistor (R5), and a second end of the fifth resistor (R5) connects to a forward input end of the voltage comparator, and first ends of the sixth resistor (R6) and the first capacitor (C1); a second end of the sixth resistor (R6) and a second end of the first capacitor (C1) are grounded, a backward input end of the voltage comparator connects to the reference voltage (VREF), an output end of the voltage comparator connects to a gate of the first FET (Q1), a source of the first FET (Q1) connects to the first output end of the control circuit, a drain of the first FET (Q1) connects to a second output end of the control circuit, the first output end of the control circuit connects to a first input end (Input1) of the feedback circuit, a second output end of the control circuit connects to the second input end (Input2) of the feedback circuit, the first input end (Input1) of the feedback circuit connects to an output end (FB) of the power management chip, and the output end (Output) of the feedback circuit connects to the gate driving voltage (VGH); and the control circuit turns on or off the first output end and the second output end of the control circuit in accordance with the gate driving voltage (VGH) to adjust the voltage at the second input end of the feedback circuit, the feedback circuit controls the voltage of the output end of the feedback circuit in accordance with the voltage at the second input end so as to adjust the gate driving voltage (VGH).

In the first embodiment, the feedback circuit includes a first resistor (R1), a second resistor (R2), a third resistor (R3), and a fourth resistor (R4), wherein: a first end of the first resistor (R1) connects to the output end (Output) of the feedback circuit, a second end of the first resistor (R1) connects to a first end of the second resistor (R2), a second end of the second resistor (R2) connects to a first end of the third resistor (R3), a second end of the third resistor (R3) connects to a first end of the fourth resistor (R4), a second end of the fourth resistor (R4) is grounded, the second end of the third resistor (R3) connects to the first input end (Input1) of the feedback circuit, and the first end of the third resistor (R3) connects to the second input end (Input2) of the feedback circuit.

In the second embodiment, the voltage compensation circuit as claimed in claim 1, wherein the output end of the voltage comparator connects to the gate of the first FET (Q1) via a latch circuit.

In the second embodiment, the latch circuit includes a second FET (Q2), a seventh resistor (R7), an eighth resistor (R8), a ninth resistor (R9), a first triode (T1), a second triode (T2) and a power source of the latch circuit, wherein: a base of the second triode (T2) connects to the output end of the voltage comparator, an emitter of the second triode (T2) connects to the source of the second FET (Q2) and is grounded, the a drain of the second FET (Q2) connects to a second end of the seventh resistor (R7), the second end of the seventh resistor (R7) connects to the gate of the first FET (Q1), the gate of the second FET (Q2) connects to a second end of the eighth resistor (R8), a first end of the eighth resistor (R8) connects to the first end of the seventh resistor (R7) and a driving voltage (VCC) of the latch circuit, a second end of the eighth resistor (R8) connects to an emitter of the first triode (T1), a base of the first triode (T1) connects to a collector of the second triode (T2), a collector of the first triode (T1) connects to a first end of the ninth resistor (R9), and a second end of the ninth resistor (R9) is grounded; and When the output end of the voltage comparator outputs the high level, the latch circuit is turned on, and the first FET (Q1) is turned on. When the first FET (Q1) is turned on, the latch circuit controls the first FET (Q1) to be in the on state.

In one embodiment, a voltage (VFB) of the output end (FB) of the power management chip is a fixed value.

In another aspect, a voltage compensation method based on the voltage compensation circuit of claim 1 includes: when the driving circuit of the LCD begins operations, configuring the voltage (VFB) of an output end (FB) of a power management chip to be a fixed value by the power management chip; obtaining an initial value of a gate driving voltage (VGH) in accordance with the voltage (VFB) of the output end (FB) of the power management chip by the feedback circuit of the voltage compensation circuit; adjusting the voltage of the second input end of the feedback circuit in accordance with the initial value of the gate driving voltage (VGH) of the control circuit by a control circuit of the voltage compensation circuit; and adjusting the voltage of the gate driving voltage (VGH) in accordance with the voltage of the second input end of the feedback circuit by a feedback circuit.

Wherein the step of obtaining an initial value of a gate driving voltage (VGH) in accordance with a voltage (VFB) of the output end (FB) of the power management chip by the feedback circuit of the voltage compensation circuit further includes: obtaining the initial value of the gate driving voltage (VGH) in accordance with the voltage (VFB) of the output end (FB) of the power management chip and the equation below by the feedback circuit:

$$VGH1=(R1+R2+R3+R4)\times VFB/R4;$$

Wherein VGH1 represents to the initial value of the gate driving voltage (VGH), R1 represents the resistance of the first resistor (R1), R2 represents the resistance of the second resistor (R2), R3 represents the resistance of the third resistor (R3), R4 represents the resistance of the fourth resistor (R4), and VFB represents the voltage of the output end (FB) of the power management chip.

Wherein the step of adjusting the voltage of the gate driving voltage (VGH) in accordance with the voltage of the second input end of the feedback circuit by the feedback circuit further includes: adjusting the gate driving voltage (VGH) in accordance with the voltage of the second input end by the equation:

$$VGH2=(R1+R2+R4)\times Vinput2/R4;$$

Wherein VGH2 represents the adjusted value of the gate driving voltage (VGH), R1 represents the resistance of the first resistor (R1), R2 represents the resistance of the second resistor (R2), R4 represents the resistance of the fourth resistor (R4), and Vinput2 represents the voltage of the second input end of the feedback circuit.

The voltage compensation circuit may adjust the voltage of the output end of the feedback circuit in accordance with the voltage of the second input end of the feedback circuit. In this way, the gate driving voltage (VGH) is adjusted so as to enhance the display performance.

BRIEF DESCRIPTION OF THE DRAWINGS

In order to more clearly illustrate the embodiments of the present disclosure or prior art, the following figures will be described in the embodiments are briefly introduced. It is obvious that the drawings are merely some embodiments of the present disclosure, those of ordinary skill in this field can obtain other figures according to these figures without paying the premise.

DETAILED DESCRIPTION OF PREFERRED EMBODIMENTS

Embodiments of the present disclosure are described in detail with the technical matters, structural features, achieved objects, and effects with reference to the accompanying drawings as follows. It is clear that the described embodiments are part of embodiments of the present disclosure, but not all embodiments. Based on the embodiments of the present disclosure, all other embodiments to those of ordinary skill in the premise of no creative efforts obtained, should be considered within the scope of protection of the present disclosure.

The technical issue that the embodiment of the present disclosure solves is to provide a voltage compensation circuit and the voltage compensation method thereof to resolve the display issue caused by the variation of the substrate temperature.

Figure 1:
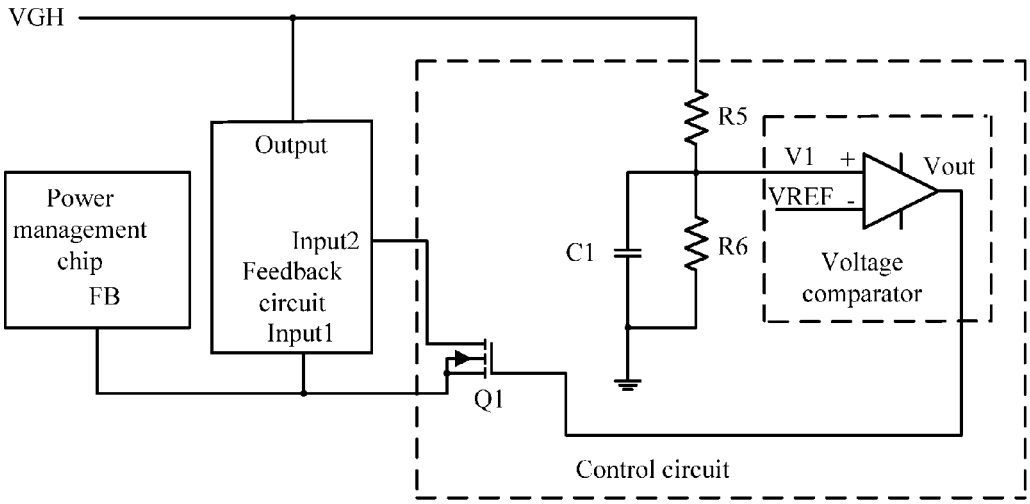
FIG. 1 is a voltage compensation circuit in accordance with one embodiment.

FIG. 1 is a voltage compensation circuit in accordance with one embodiment. The voltage compensation circuit includes a power management chip, a feedback circuit, and a control circuit.

The control circuit includes a first field effect transistor (FET) Q1, a voltage comparator, a fifth resistor (R5), a sixth resistor (R6) and a first capacitor (C1).

The gate driving voltage (VGH) connects an input end of the control circuit, the input end of the control circuit connects to a first end of the fifth resistor (R5), and a second end of the fifth resistor (R5) connects to a forward input end of the voltage comparator, and first ends of the sixth resistor (R6) and the first capacitor (C1). A second end of the sixth resistor (R6) and a second end of the first capacitor (C1) are grounded. A backward input end of the voltage comparator connects to the reference voltage (Vref), an output end of the voltage comparator connects to a gate of the first FET (Q1), a source of the first FET (Q1) connects to the first output end of the control circuit, a drain of the first FET (Q1) connects to a second output end of the control circuit, the first output end of the corresponding connects to a first input end (Input1) of the feedback circuit, a second output end of the control circuit connects to the second input end (Input2) of the feedback circuit, the first input end (Input1) of the feedback circuit connects to an output end (FB) of the power management chip, and the output end (Output) of the feedback circuit connects to the gate driving voltage (VGH).

The control circuit turns on or off the first output end and the second output end of the control circuit in accordance with the gate driving voltage (VGH) to adjust the voltage at the second input end of the feedback circuit. The feedback circuit controls the voltage of the output end of the feedback circuit in accordance with the voltage at the second input end so as to adjust the gate driving voltage (VGH).

In the embodiment, the output end (FB) of the power management chip provides the voltage to the first input end (Input1) of the feedback circuit. When the driving circuit of the LCD begins its operation, the power management chip provides the feedback voltage (VFB) for the first input end (Input1) of the feedback circuit. At this moment, the first capacitor (C1) begins charge operation, and the voltage (V1) at two ends of the first capacitor (C1) is smaller. The voltage (V1) of the forward input end of the voltage comparator is smaller than the voltage (VREF) of the backward input end of the voltage comparator. The output end of the voltage comparator outputs a low level, and the first FET (Q1) of the voltage comparator is in an off state. At this moment, the first output end and the second output end of the control circuit are not connected, the voltage of second input end (Input2) of the feedback circuit is larger than the voltage of the first input end (Input1) of the feedback circuit. At this moment, an initial value of the gate driving voltage (VGH) is higher. After a period of time, when the voltage (V1) of the forward input end of the voltage comparator is larger than the voltage (VREF) of the backward input end of the voltage comparator, the output end of the voltage comparator outputs a high level, and the first FET (Q1) of the voltage comparator is in an on state. At this moment, the first output end and the second output end of the control circuit are connected, the voltage of second input end (Input2) of the feedback circuit equals to the voltage of the first input end (Input1) of the feedback circuit. The voltage of the output end of the feedback circuit (Voutput) is decreased, and so does the gate driving voltage (VGH).

Alternatively, the voltage (VFB) of the output end (FB) of the power management chip is a fixed value.

Specifically, the power management chip configures the voltage (VFB) of the output end (FB) of the power management chip to be the fixed value. As such, the voltage (Vinput1) of the first input end (Input1) of the feedback circuit is also the fixed value. When the driving circuit of the LCD begins its operation, the power management chip provides the voltage (VFB) to the first input end (Input1) of the feedback circuit. At this moment, the first capacitor (C1) begins charge operation, and the voltage (V1) at two ends of the first capacitor (C1) is smaller. The voltage (V1) of the forward input end of the voltage comparator is smaller than the voltage (VREF) of the backward input end of the voltage comparator. The output end of the voltage comparator outputs the low level, and the first FET (Q1) of the voltage comparator is in an off state. At this moment, the first output end and the second output end of the control circuit are not connected, the voltage of second input end (Input2) of the feedback circuit is larger than the voltage of the first input end (Input1) of the feedback circuit. At this moment, an initial value of the gate driving voltage (VGH) is higher. After a period of time, when the voltage (V1) of the forward input end of the voltage comparator is larger than the voltage (VREF) of the backward input end of the voltage comparator, the output end of the voltage comparator outputs a high level, and the first FET (Q1) of the voltage comparator is in an on state. At this moment, the first output end and the second output end of the control circuit are connected, the voltage of second input end (Input2) of the feedback circuit equals to the voltage of the first input end (Input1) of the feedback circuit. The voltage of the output end of the feedback circuit (Voutput) is decreased, and so does the gate driving voltage (VGH).

In the embodiment, when the driving circuit of the LCD begins its operations, the TFTs within the LCD also begin the operations. At this moment, the temperature of the TFTs is low, and thus a higher gate driving voltage is needed. After a period of time, when the temperature of the TFTs is getting higher, the gate driving voltage has to be lowered down such that the TFTs are driven by an appropriate voltage. The grayscale of the LCD may be not uniform due to the high driving voltage or low driving voltage, and the display performance may be affected. In the embodiment, after the LCD is turned on, the gate driving voltage is increased. After the temperature of the TFTs is increased, the gate driving voltage is decreased. In this way, the display performance of the LCD is enhanced by adjusting the gate driving voltage.

Figure 2:
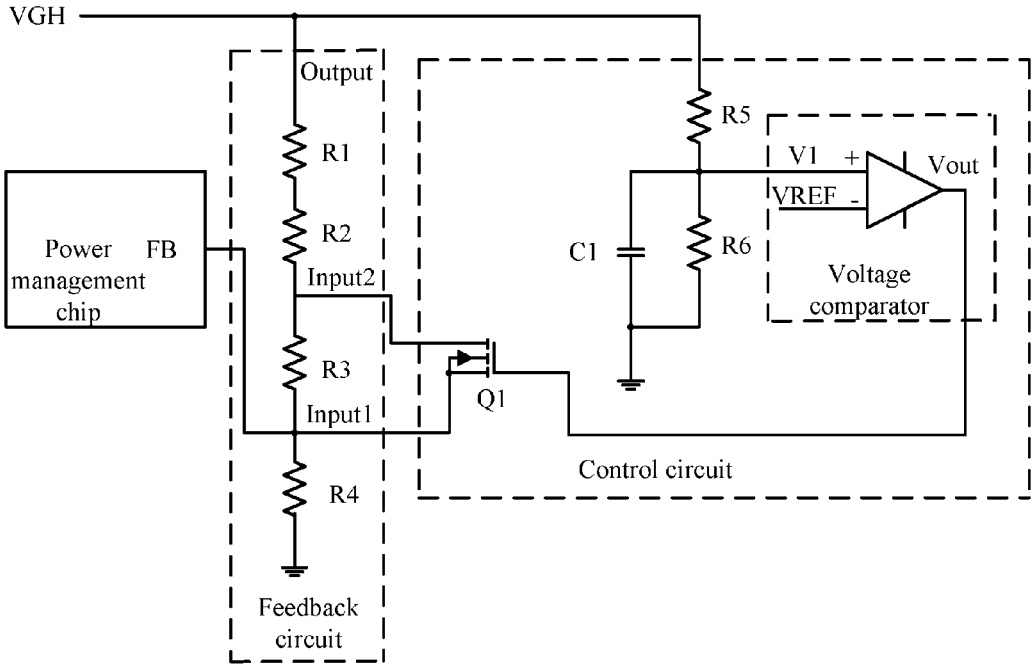
FIG. 2 is a voltage compensation circuit in accordance with another embodiment.

FIG. 2 is a voltage compensation circuit in accordance with another embodiment. The voltage compensation circuit includes the power management chip, the feedback circuit, and the control circuit of FIG. 1. The feedback circuit includes a first resistor (R1), a second resistor (R2), a third resistor (R3), and a fourth resistor (R4).

A first end of the first resistor (R1) connects to the output end (Output) of the feedback circuit, a second end of the first resistor (R1) connects to a first end of the second resistor (R2), a second end of the second resistor (R2) connects to a first end of the third resistor (R3), a second end of the third resistor (R3) connects to a first end of the fourth resistor (R4), a second end of the fourth resistor (R4) is grounded, the second end of the third resistor (R3) connects to the first input end (Input1) of the feedback circuit, and the first end of the third resistor (R3) connects to the second input end (Input2) of the feedback circuit.

In the embodiment, the output end (Output) of the feedback circuit connects to the gate driving voltage (VGH), the first input end (Input1) of the feedback circuit connects to the output end (FB) of the power management chip and the source of the first FET (Q1) of the control circuit, the second input end (Input2) of the feedback circuit connects to the drain of the first FET (Q1).

When the driving circuit of the LCD begins its operation, the power management chip provides the voltage (VFB) to the first input end (Input1) of the feedback circuit. At this moment, the first capacitor (C1) begins charge operation, and the voltage (V1) at two ends of the first capacitor (C1) is smaller. The voltage (V1) of the forward input end of the voltage comparator is smaller than the voltage (VREF) of the backward input end of the voltage comparator. The output end of the voltage comparator outputs the low level, and the first FET (Q1) of the voltage comparator is in an off state. At this moment, the first output end and the second output end of the control circuit are not connected, the voltage of the first input end (Input1) of the feedback circuit is VFB, the voltage of the second input end (Input2) of the feedback circuit is larger than the voltage of the first input end (Input1) of the feedback circuit. At this moment, an initial value of the gate driving voltage (VGH) is higher. If the initial value of the gate driving voltage (VGH) is VGH1, where VHG1=(R1+R2+R3+R4)×VFB/R4.

After a period of time, when the voltage (V1) of the forward input end of the voltage comparator is larger than the voltage (VREF) of the backward input end of the voltage comparator, the output end of the voltage comparator outputs the high level, and the first FET (Q1) of the voltage comparator is in the on state.

At this moment, the source of the first FET (Q1) and the drain of the first FET (Q1) are connected, the voltage of second input end (Input2) of the feedback circuit equals to the voltage of the first input end (Input1) of the feedback circuit. The voltage of the second input end is VFB, the voltage of the output end of the feedback circuit (Voutput) is decreased, and so does the gate driving voltage (VGH). At this moment, if the gate driving voltage is VGH2, where VGH2=(R1+R2+R4)×VFB/R4.

Figure 3:
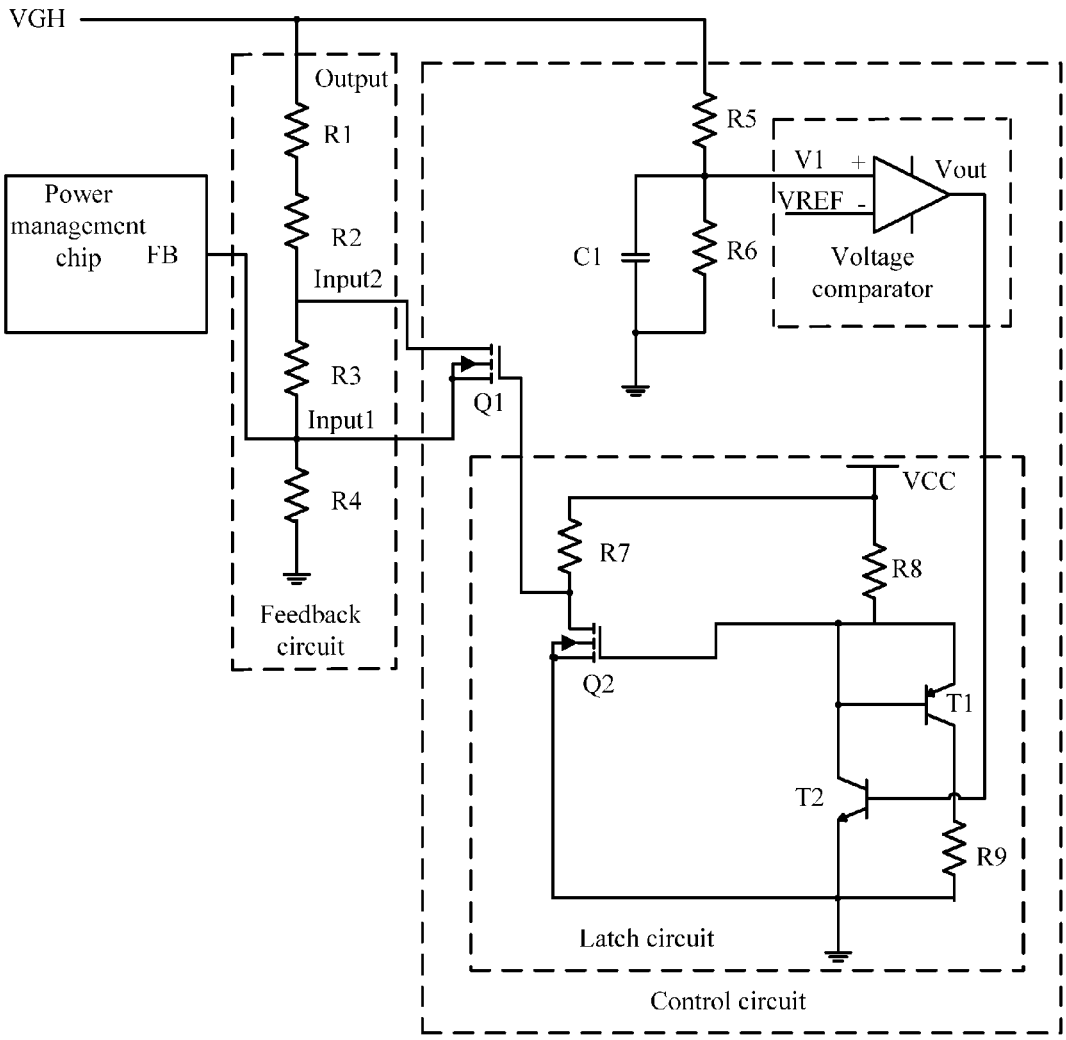
FIG. 3 is a voltage compensation circuit in accordance with another embodiment.

FIG. 3 is a voltage compensation circuit in accordance with another embodiment. The voltage compensation circuit includes the power management chip, the feedback circuit, and the control circuit of FIG. 1. In addition, the output end of the voltage comparator connects to the gate of the first FET (Q1) via a latch circuit. The latch circuit includes a second FET (Q2), a seventh resistor (R7), an eighth resistor (R8), a ninth resistor (R9), a first triode (T1), a second triode (T2) and a power source of the latch circuit.

A base of the second triode (T2) connects to the output end of the voltage comparator, an emitter of the second triode (T2) connects to the source of the second FET (Q2) and is grounded, the a drain of the second FET (Q2) connects to a second end of the seventh resistor (R7), the second end of the seventh resistor (R7) connects to the gate of the first FET (Q1), the gate of the second FET (Q2) connects to a second end of the eighth resistor (R8), a first end of the eighth resistor (R8) connects to the first end of the seventh resistor (R7) and a driving voltage (VCC) of the latch circuit, a second end of the eighth resistor (R8) connects to an emitter of the first triode (T1), a base of the first triode (T1) connects to a collector of the second triode (T2), a collector of the first triode (T1) connects to a first end of the ninth resistor (R9), and a second end of the ninth resistor (R9) is grounded.

When the output end of the voltage comparator outputs the high level, the latch circuit is turned on, and the first FET (Q1) is turned on. When the first FET (Q1) is turned on, the latch circuit controls the first FET (Q1) to be in the on state.

In the embodiment, the driving voltage (VCC) of the latch circuit provides the power to the latch circuit. The driving voltage is in a range between 3 and 5 V. When the output end of the voltage comparator outputs the high level, the latch circuit controls the first FET (Q1) to be in the on state.

When the output end of the voltage comparator outputs the low level, the gate driving voltage is prevented from getting high such that the display performance may be enhanced. When the driving circuit of the LCD begins its operation, the power management chip provides the feedback voltage (VFB) for the first input end (Input1) of the feedback circuit. At this moment, the first capacitor (C1) begins charge operation, and the voltage (V1) at two ends of the first capacitor (C1) is smaller. The voltage (V1) of the forward input end of the voltage comparator is smaller than the voltage (VREF) of the backward input end of the voltage comparator. The output end of the voltage comparator outputs the low level, the first triode (T1) and the second triode (T2) are in the off state. The first FET (Q1) is in the off state, and the second FET (Q2) is in the on state. At this moment, the first output end and the second output end of the control circuit are not connected, the voltage of second input end (Input2) of the feedback circuit is larger than the voltage of the first input end (Input1) of the feedback circuit. At this moment, an initial value of the gate driving voltage (VGH) is higher. After a period of time, when the voltage (V1) of the forward input end of the voltage comparator is larger than the voltage (VREF) of the backward input end of the voltage comparator, the output end of the voltage comparator outputs the high level, the first triode (T1) is turned on. Afterward, the second triode (T2) is turned on. At this moment, the first FET (Q1) of the voltage comparator is in the on state, and the second FET (Q2) is in the off state. At this moment, the first output end and the second output end of the control circuit are connected, the voltage of second input end (Input2) of the feedback circuit is decreased, and the voltage of the second input end (Input2) of the feedback circuit equals to the voltage of the first input end (Input1) of the feedback circuit. The voltage of the output end of the feedback circuit (Voutput) is decreased, and so does the gate driving voltage (VGH). After the gate driving voltage (VGH) is stabilized, if the output end of the voltage comparator outputs the low level, the first FET (Q1) of the latch circuit is in the on state. This can prevent the bad display performance due to the increasing gate driving voltage. In the embodiment, after the operations of the LCD becomes stable, the gate driving voltage is stable regardless of the high level or low level outputted by the voltage comparator.

Figure 4:
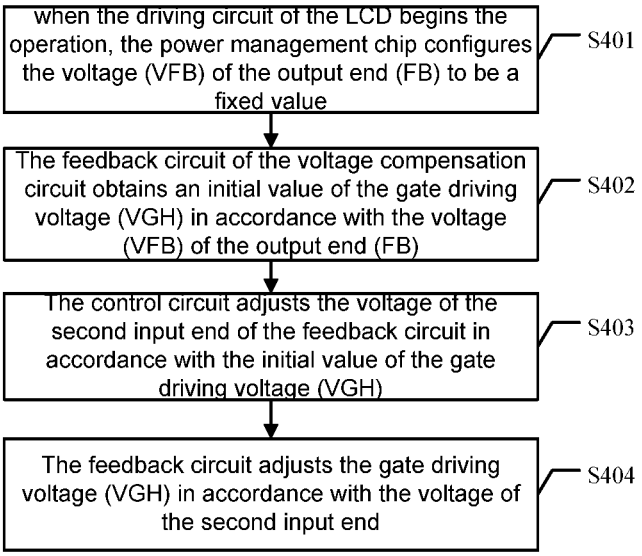
FIG. 4 is a flowchart of the voltage compensation method in accordance with one embodiment.

FIG. 4 is a flowchart of the voltage compensation method in accordance with one embodiment. The method includes the following steps.

In step S401, when the driving circuit of the LCD begins the operation, the power management chip configures the voltage (VFB) of the output end (FB) of the power management chip to be a fixed value.

In the embodiment, referring to FIG. 1, when the driving circuit of the LCD begins the operation, the power management chip also begins its operations. The power management chip configures the voltage (VFB) of the output end (FB) of the power management chip to be a fixed value in accordance with procedures. When the VFB is the fixed value, the voltage (Vinput1) of the first input end (Input1) of the feedback circuit is also the fixed value.

In step S402, the feedback circuit of the voltage compensation circuit obtains an initial value of the gate driving voltage (VGH) in accordance with the voltage (VFB) of the output end (FB) of the power management chip.

In the embodiment, the initial value of the gate driving voltage (VGH) may be adjusted by the resistance of the feedback circuit and the voltage (VFB) of the output end (FB) of the power management chip.

Alternatively, the step S402 further includes: the feedback circuit obtains the initial value of the gate driving voltage (VGH) by the voltage (VFB) of the output end (FB) of the power management chip in accordance with the equation below:

$$VGH1=(R1+R2+R3+R4)\times VFB/R4;$$

wherein VGH1 represents to the initial value of the gate driving voltage (VGH), R1 represents the resistance of the first resistor (R1), R2 represents the resistance of the second resistor (R2), R3 represents the resistance of the third resistor (R3), R4 represents the resistance of the fourth resistor (R4), and VFB represents the voltage of the output end (FB) of the power management chip.

In step S403, the control circuit adjusts the voltage of the second input end of the feedback circuit in accordance with the initial value of the gate driving voltage (VGH).

In the embodiment, referring to FIG. 1, when the initial value of the gate driving voltage (VGH) is high, the output end of the voltage comparator outputs the high level the control circuit adjusts the voltage of the second input end of the feedback circuit such that the voltage of the second output end equals to the voltage of the first input end of the feedback circuit. In this way, the voltage of the second input end of the feedback circuit is adjusted to be the VFB.

In step S404, the feedback circuit adjusts the gate driving voltage (VGH) in accordance with the voltage of the second input end.

In the embodiment, referring to FIG. 1, the gate driving voltage (VGH) may be adjusted in accordance with the relationship between the voltage of the second input end of the feedback circuit and the gate driving voltage (VGH). When the voltage of the second input end is increased, the gate driving voltage (VGH) is also increased. When the voltage of the second input end is decreased, the gate driving voltage (VGH) is also decreased.

Alternatively, the step S404 may further include: the feedback circuit adjusts the gate driving voltage (VGH) in accordance with the voltage of the second input end by the equation below:

$$VGH2=(R1+R2+R4)\times V\text{input}2/R4;$$

wherein VGH2 represents the adjusted value of the gate driving voltage (VGH), R1 represents the resistance of the first resistor (R1), R2 represents the resistance of the second resistor (R2), R4 represents the resistance of the fourth resistor (R4), and Vinput2 represents the voltage of the second input end of the feedback circuit.

In the embodiment, when the driving circuit of the LCD begins its operation, the power management chip provides the feedback voltage (VFB) for the first input end (Input1) of the feedback circuit. At this moment, the first capacitor (C1) begins charge operation, and the voltage (V1) at two ends of the first capacitor (C1) is smaller. The voltage (V1) of the forward input end of the voltage comparator is smaller than the voltage (VREF) of the backward input end of the voltage comparator. The output end of the voltage comparator outputs the low level, and the first FET (Q1) of the voltage comparator is in the off state. At this moment, the first output end and the second output end of the control circuit are not connected, the voltage of second input end (Input2) of the feedback circuit is larger than the voltage of the first input end (Input1) of the feedback circuit. At this moment, an initial value of the gate driving voltage (VGH) is higher. After a period of time, when the voltage (V1) of the forward input end of the voltage comparator is larger than the voltage (VREF) of the backward input end of the voltage comparator, the output end of the voltage comparator outputs a high level, and the first FET (Q1) of the voltage comparator is in an on state. At this moment, the first output end and the second output end of the control circuit are connected, the voltage of second input end (Input2) of the feedback circuit equals to the voltage of the first input end (Input1) of the feedback circuit. The voltage of the output end of the feedback circuit (Voutput) is decreased, and so does the gate driving voltage (VGH).

In the embodiment, when the driving circuit of the LCD begins its operations, the TFTs within the LCD also begin the operations. At this moment, the temperature of the TFTs is low, and thus a higher gate driving voltage is needed. After a period of time, when the temperature of the TFTs is getting higher, the gate driving voltage has to be lowered down such that the TFTs are driven by an appropriate voltage. The grayscale of the LCD may be not uniform due to the high driving voltage or low driving voltage, and the display performance may be affected. In the embodiment, after the LCD is turned on, the gate driving voltage is increased. After the temperature of the TFTs is increased, the gate driving voltage is decreased. The grayscale of the LCD may be not uniform due to the high driving voltage or low driving voltage, and the display performance may be affected. In the embodiment, after the LCD is turned on, the gate driving voltage is increased. After the temperature of the TFTs is increased, the gate driving voltage is decreased. In this way, the display performance of the LCD is enhanced by adjusting the gate driving voltage.

Above are embodiments of the present disclosure, which does not limit the scope of the present disclosure. Any modifications, equivalent replacements or improvements within the spirit and principles of the embodiment described above should be covered by the protected scope of the disclosure.

What is claimed is:

1. A voltage compensation method, comprising the following steps:

providing a voltage compensation circuit, wherein the voltage compensation circuit comprises:

a power management chip, a feedback circuit, and a control circuit, wherein: the control circuit comprises a first field effect transistor (FET) (Q1), a voltage comparator, a fifth resistor (R5), a sixth resistor (R6) and a first capacitor (C1), a gate driving voltage (VGH) connects an input end of the control circuit, the input end of the control circuit connects to a first end of the fifth resistor (R5), and a second end of the fifth resistor (R5) connects to a forward input end of the voltage comparator, and first ends of the sixth resistor (R6) and the first capacitor (C1), a second end of the sixth resistor (R6) and a second end of the first capacitor (C1) are grounded, a backward input end of the voltage comparator connects to the reference voltage (VREF), an output end of the voltage comparator connects to a gate of the first FET (Q1), a source of the first FET (Q1) connects to the first output end of the control circuit, a drain of the first FET (Q1) connects to a second output end of the control circuit, the first output end of the control circuit connects to a first input end (Input1) of the feedback circuit, a second output end of the control circuit connects to the second input end (Input2) of the feedback circuit, the first input end (Input1) of the feedback circuit connects to an output end (FB) of the power management chip, and the output end (Output) of the feedback circuit connects to the gate driving voltage (VGH), and the control circuit turns on or off the first output end and the second output end of the control circuit in accordance with the gate driving voltage (VGH) to adjust the voltage at the second input end of the feedback circuit, the feedback circuit controls the voltage of the output end of the feedback circuit in accordance with the voltage at the second input end so as to adjust the gate driving voltage (VGH);

configuring the voltage (VFB) of an output end (FB) of a power management chip to be a fixed value by the power management chip when the driving circuit of the LCD begins operations;

obtaining an initial value of a gate driving voltage (VGH) in accordance with the voltage (VFB) of the output end (FB) of the power management chip by the feedback circuit of the voltage compensation circuit;

adjusting the voltage of the second input end of the feedback circuit in accordance with the initial value of the gate driving voltage (VGH) of the control circuit by a control circuit of the voltage compensation circuit; and adjusting the voltage of the gate driving voltage (VGH) in accordance with the voltage of the second input end of the feedback circuit by a feedback circuit.

2. The voltage compensation method as claimed in claim 1, wherein the step of obtaining an initial value of a gate driving voltage (VGH) in accordance with a voltage (VFB) of the output end (FB) of the power management chip by the feedback circuit of the voltage compensation circuit further comprises:

obtaining the initial value of the gate driving voltage (VGH) in accordance with the voltage (VFB) of the output end (FB) of the power management chip and the equation below by the feedback circuit:

$$VGH1=(R1+R2+R3+R4)\times VFB/R4;$$

wherein VGH1 represents to the initial value of the gate driving voltage (VGH), R1 represents the resistance of the first resistor (R1), R2 represents the resistance of the second resistor (R2), R3 represents the resistance of the third resistor (R3), R4 represents the resistance of the fourth resistor (R4), and VFB represents the voltage of the output end (FB) of the power management chip.

3. The method as claimed in claim 1, wherein the step of adjusting the voltage of the gate driving voltage (VGH) in accordance with the voltage of the second input end of the feedback circuit by the feedback circuit further comprises:

adjusting the gate driving voltage (VGH) in accordance with the voltage of the second input end by the equation:

$$VGH2=(R1+R2+R4)\times V\text{input}2/R4;\text{ and}$$

wherein VGH2 represents the adjusted value of the gate driving voltage (VGH), R1 represents the resistance of the first resistor (R1), R2 represents the resistance of the second resistor (R2), R4 represents the resistance of the fourth resistor (R4), and Vinput2 represents the voltage of the second input end of the feedback circuit.

* * * * *